United States Patent [19]

Scholes

[11] Patent Number: 4,458,706

[45] Date of Patent: Jul. 10, 1984

[54] BLOCK AND BLEED VALVE SYSTEM

[75] Inventor: Alan Scholes, Glasgow, Scotland

[73] Assignee: Keystone International, Inc., Houston, Tex.

[21] Appl. No.: 351,948

[22] Filed: Feb. 24, 1982

[30] Foreign Application Priority Data

Feb. 25, 1981 [GB] United Kingdom ..... 8105899

[51] Int. Cl.[3] ..... B08B 3/04

[52] U.S. Cl. ..... 134/166 R; 134/98; 137/240; 137/637.1

[58] Field of Search ..... 134/96–98, 134/166 R, 166 C, 169 C; 137/240, 312, 637.1

[56] References Cited

U.S. PATENT DOCUMENTS 599,283 2/1898 Freitas ..... 137/637.1

3,031,148 4/1962 Holdren ..... 134/166 R 4,373,545 2/1983 Knappe ..... 137/240

*Primary Examiner*—John W. Shepperd

*Assistant Examiner*—Renee S. Kidorf

*Attorney, Agent, or Firm*—Browning, Bushman, Zamecki & Anderson

[57] ABSTRACT

This invention relates to a block and bleed valve system comprising a chamber 2 having first and second fluid passage openings 6,7 provided with first and second valves 10,11, and connected in use of the system to respective pipe sections 26,27 from which the chamber 2 is isolatable in use by closure of said first and second valves 10,11. The chamber 2 also has a drain opening 9 provided with a drain valve 15; and a spray means 18 having a spray head 21 formed and disposed in the chamber 2 for spraying substantially all the interior surfaces of the chamber 2 with cleaning fluid.

9 Claims, 2 Drawing Figures

BLOCK AND BLEED VALVE SYSTEM

Figure 1:
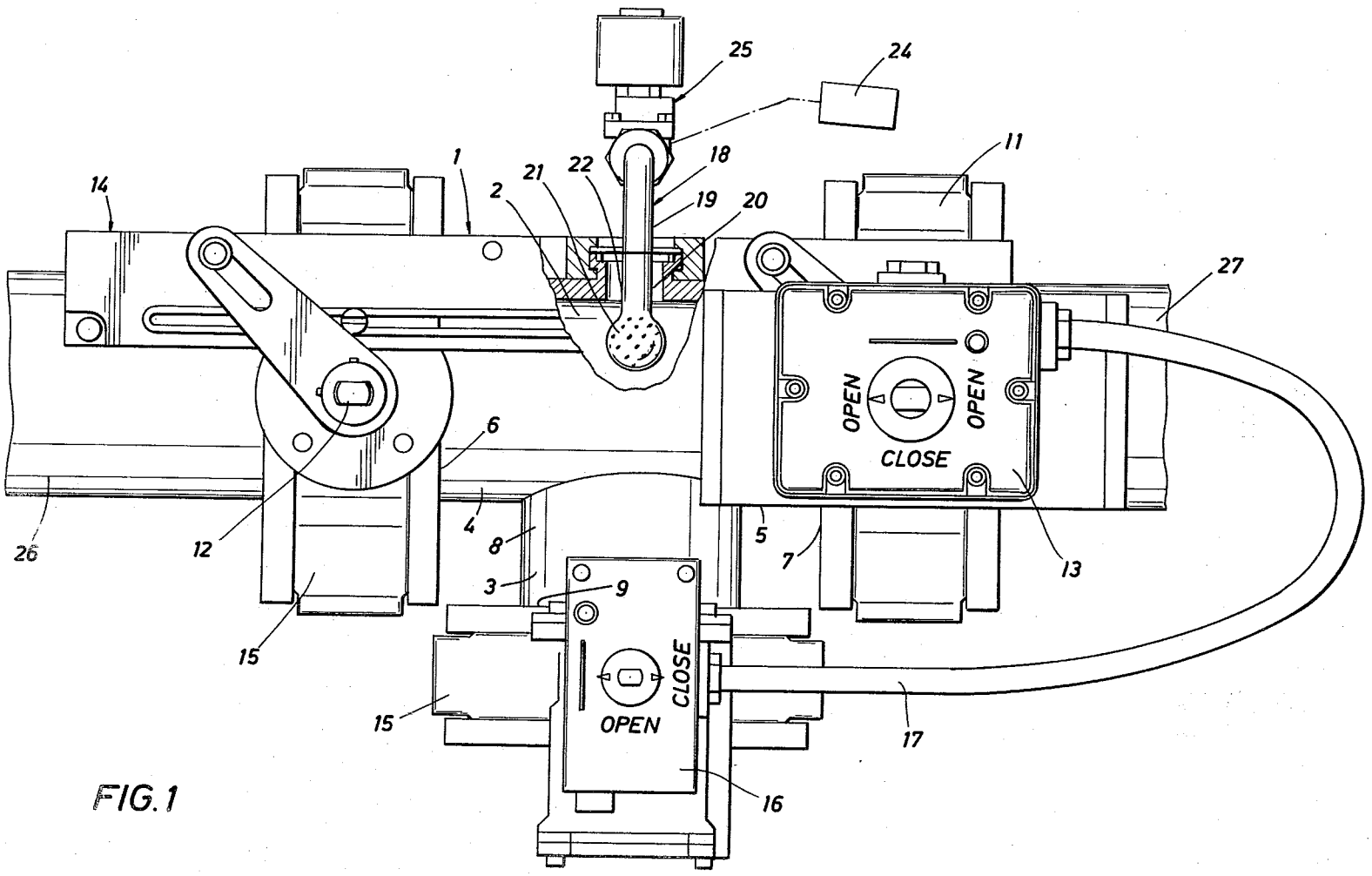

This invention relates to block and bleed valve systems suitable for use in complex pipe systems which require periodic internal cleansing.

With many complex pipework systems used for handling liquid food materials e.g. in dairies and breweries, there is an ever-present risk of contamination e.g. with bacterial infections and it is therefore essential to provide for internal cleaning of the pipework at regular intervals. Such pipework is, however, often extensive and complex so that thorough cleaning is difficult and time consuming and may even necessitate dismantling of part of the pipework thereby resulting in significant down-time of the plant.

Although conventional valve isolating systems permit satisfactory cleaning of most of the pipework their use involves significant risks insofar as there are normally present dead-spaces in the vicinity of the valves which are not accessible to the cleaning fluid or at least not to the physical action thereof. Also such systems do not provide any protection against leakage of cleaning fluid from one part of the pipework on one side of the valve system to another part on the other side which still contains food material which as a result could become seriously contaminated.

One previous attempt to solve these problems involves the use of a complex and very expensive valve construction having special fittings on opposite sides of each of two pipes linked by the system, a special form of valve closure and seating therefor, a valve spindle extending right through both pipes and said fittings with seals therearound, and special ducting inside the valve spindle for the introduction and drainage of cleaning fluid to and from the system.

It is an object of the present invention to overcome or minimize one or more of the above problems in a simple and economical manner.

The present invention provides a block and bleed valve system comprising a chamber having first and second fluid passage openings provided with first and second valve means, respectively, and connectable, in use of the system, to respective pipe sections from which said chamber is isolatable in use by closure of said first and second valve means; a drain opening provided with a drain valve; and a spray means having an inlet in communication with the exterior of the chamber for connection, in use, with a cleaning fluid supply, and having a spray head formed and disposed in said chamber for spraying, in use, substantially all the interior surfaces of said chamber with cleaning fluid supplied thereto.

The valve system of the present invention permits thorough and effective cleaning of pipework to either side thereof as well as in its own interior whilst providing good protection against accidental leakage of cleaning material to parts of the system not undergoing cleaning and whilst employing a relatively simple and inexpensive form of construction using more or less readily available components which do not require special manufacture.

Figure 2:
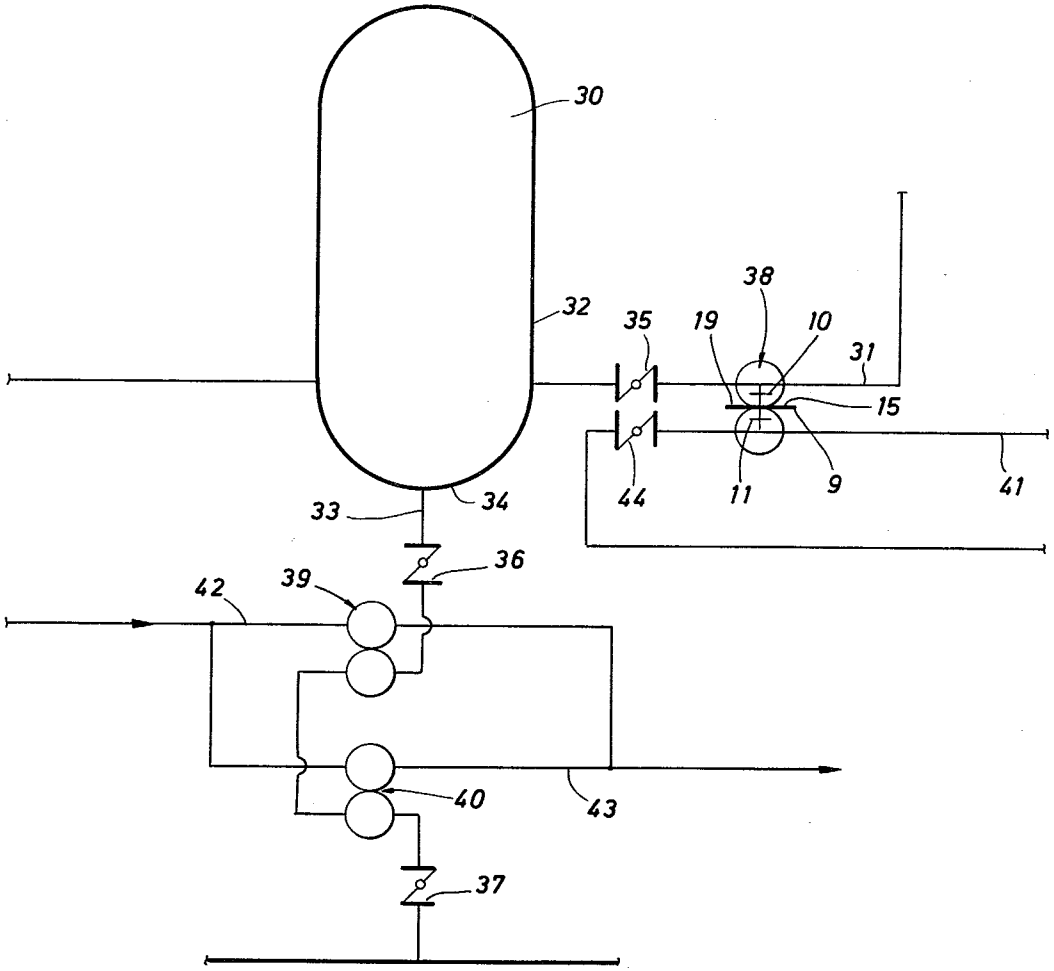

Further preferred features and advantages of the invention will appear from the following description given by way of example of an embodiment illustrated with reference to the accompanying drawings in which:

FIG. 1 is a partially sectioned front elevation of a valve system of the invention; and FIG. 2 is a schematic circuit diagram of a pipework arrangement illustrating the use of the system of FIG. 1.

FIG. 1 shows a valve system 1 comprising a chamber 2 constituted by a Tee-pipe 3 whose cross-piece provides first and second arms 4,5 terminating in first and second fluid passage openings 6,7, respectively and whose other member 8 terminates in a drain opening 9.

The fluid passage openings 6,7 are provided with respective first and second valve means 10,11 in the form of conventional butterfly valves provided with rotary drive shafts 12. A hydraulic actuator 13 is provided on the second valve 11 for opening and closing the latter and is connected by a simple parallel arm linkage 14 to the first valve 10 for simultaneous operation thereof with the second valve 11. The drain opening 9 is also provided with a valve means in the form of a butterfly valve 15 which is also provided with an actuator 16. The drain opening 9 and drain valve 15 preferably have a flow capacity corresponding to a substantial proportion of the flow capacity of one of the valves means 10, 11 and respective first or second fluid passage openings 6, 7. The latter is connected via a hydraulic fluid line 17 the second valve means actuator 13 for simultaneous operation therewith so that as the first and second valves 10,11 are closed, the drain valve 15 is opened and as the former are opened the latter is closed. Directly opposite the member 8 with the drain outlet 9 is provided a spray means 18 in the form of a conduit 19 extending through an opening 20 with a spray head 21 at its free end 22 disposed in the chamber 2 and having an inlet 23 at its other end connected to a cleaning fluid supply 24 via a control valve 25.

The first and second fluid passage openings 6,7 are connected via the butterfly valves 10,11 to respectively pipe sections 26,27 of a pipework circuit 28 (see below) in conventional manner.

The spray head 21 of the spray means 19 is of the ball type and as may be seen from the drawing is formed and positioned in the chamber so that in use cleaning fluid will be sprayed therefrom over substantially the whole of the interior surface of the chamber 2 including interior walls of the arms 4,5 member 8, inlet 20, and the respective inwardly directed faces of the butterfly valves 10, 11, 15. Although this arrangement is particularly convenient other forms of spray head could also be used as well as more than one spray head, different spray heads being used for different parts of the chamber 2.

Naturally other forms of valve could be used instead of butterfly valves and different forms of actuators without affecting the basic mode of operation of the system which will now be described with reference to FIG. 2.

FIG. 2 shows a processing tank 30 with a first beer main 31 connected to one side 32 and a second beer main 33 connected to the base 34 thereof. The beer mains are provided with conventional closing valves 35–37 and are also connected in parallel, via respective block and bleed valves systems 38–40 of the invention, to C.I.P. (Cleaning-In-Place) fluid mains 41–43.

The block and bleed valve systems 38–40 are shown essentially schematically except in the case of the one 38 connected in the first beer main 31, wherein there are schematically indicated the first and second butterfly valves 10,11, the drain opening 9 provided with its butterfly valve 15, and the (C.I.P.) spray conduit 19.

In use of the system with the first and second butterfly valves 10,11 both closed the beer main is entirely isolated from the C.I.P. main with a high degree of security. When it is desired to clean the relevant section of the beer main the closing valve 35 between the side 32 of the tank 30 and the block and bleed valve system 38 is closed as is also a corresponding closing valve 44 in the C.I.P. main 41. The first and second butterfly valves 10,11 are opened and C.I.P. fluid is diverted from the C.I.P. main 41 through the first beer main 31 the drain valve 15 being closed at this stage. After completion of the cleaning cycle, the first and second butterfly valves 10, 11 are both closed and the zone therebetween cleaned by passing C.I.P. fluid through the spray conduit 19 and spray head 21 thereof and drained off through the outlet 9 the butterfly valve 15 thereof having now been opened for this purpose. By this means the whole of the section of the overall circuit covered by the block and bleed valve system 38 can be readily cleaned in a simple and effective manner.

During normal operation of this plant both the first and second valves 10,11 remain closed. The drain valve 15 is however kept open so that in the event that the sealing at either of the first and second valves 10,11 should fail any leakage is drained off safely thereby preventing any possible build up of pressure between the first and second valves 10,11 thereby protecting against the possibility of leakage from one side of the system-across both the first and second valves 10,11-to the other side of the system. In practice there would normally be provided a tundish or other receptacle below the drain outlet 9 to catch any leakage so that any seal failure would be indicated by the presence of liquid in the tundish and thus quickly detected.

Various modifications to the above form of construction within the scope of the present invention will be readily apparent to those skilled in the art. Thus, for example, pneumatically operated actuators can be used instead of hydraulically operated ones and indeed may be preferred to the latter. Also other forms of mechanical linkage between the first and second valves could be used in place of the parallel arm linkage 14 - for example there could be used a rack and pinion linkage. Alternatively simultaneous operation of the first and second valves could be provided by means of a suitable hydraulic or pneumatic control circuit linking respective actuators associated with each of the first and second valves.

With regard to the use of the block and bleed system of the present invention it will be noted that in contrast to previously known systems it can be simply installed in straight pipe runs and does not require special design of the three dimensional layout of the pipes in the plant in which it is used to provide cross-over points between adjacent pipes to permit installation of the system at such points. Thus not only does the present invention provide a valve system which is relatively simple in construction and thus potentially more reliable, as well as being relatively economical to manufacture, it also simplifies and reduces the costs of the overall plant design.

It will also be appreciated that the block and bleed system of the invention may be used in different ways from that specifically described above. Thus for example it could be installed in line with a beer or other liquid main at one or more points therein for isolation of different sections of the main as required. In this case during normal operation both the first and second valves are kept open for passage of beer therethrough and the drain valve kept closed. Then when it is desired to isolate a section of the main the first and second valve are closed and the drain valve opened so that if C.I.P. or other fluid is then introduced into the section on one side of the system it is securely prevented from coming into contact with the section on the other side thereby preventing contamination of any beer or other liquid present therein by the C.I.P. fluid.

Desirably the drain or bleed valve is interlocked with the first and second valves so that when the latter are open the former cannot be opened thereby preventing the possibility of accidental loss of fluid during normal fluid flow through the system via said first and second fluid passage openings.

In further aspects the present invention provides: a liquid food material handling plant having a complex pipe system including at least one pipe run wherein there is connected in line with said pipe run a double block and bleed valve system of the invention, said pipe run having first and second sections extending to either side of said valve system and coupled to said first and second fluid passage openings of said valve system; and a liquid food material handling plant having a complex pipe system including at least one first pipe run for liquid food material and at least one second pipe run for cleaning-in-place fluid wherein there is connected across said pipe runs a double block and bleed valve system of the invention, with the first and second fluid passage openings of said valve system connected to respective ones of said first and second pipe runs.

What is claimed is:

1. A double block and bleed valve system comprising a valve body defining a valve chamber having first and second fluid passage openings provided with first and second valve means, respectively, and connectable, in use of the system, to respective ones of first and second pipelines from which said chamber is isolatable in use by closure of said first and second valve means; a drain opening provided with a drain valve; and a spray means having an inlet in communication with the exterior of the chamber for connection, in use, with a cleaning fluid supply, and having at least one spray head formed and disposed in said chamber for spraying, in use, substantially all the interior surfaces of said chamber with cleaning fluid supplied thereto when said first and second valve means are in their closed positions; said first and second valve means and drain valve, and said valve chamber being formed and arranged so that said valve chamber is substantially unobstructed when said first and second valve means are in said closed positions.

2. A valve system as claimed in claim 1 wherein said first and second valve means comprise butterfly valves.

3. A valve system as claimed in claim 1 wherein said drain opening and drain valve have a flow capacity corresponding to a substantial proportion of the flow capacity of one of said first and second valves and respective first or second fluid passage opening.

4. A liquid food material handling plant having a complex pipe system including at least one pipe run wherein is connected in line with said pipe run a double block and bleed valve system as claimed in claim 1, said pipe run having first and second sections extending to either side of said valve system and coupled to said first and second fluid passage openings of said valve system.

5. A liquid food material handling plant having a complex pipe system including at least one first pipe run for liquid food material and at least one second pipe run for cleaning-in-place fluid, wherein is connected across said pipe runs a double block and bleed valve system as claimed in claim 1, with the first and second fluid passage openings of said valve system connected to respective ones of said first and second pipe runs.

6. A valve system as claimed in claim 1 wherein said valve body is formed and arranged so as to be connectable to said pipelines substantially without obstruction of fluid along said pipelines.

7. A valve system as claimed in claim 1 wherein the first and second valves are provided with valve actuation means arranged for simultaneous opening and closure of said first and second valves.

8. A valve system as claimed in claim 7 wherein the drain valve is provided with a valve actuating means arranged for operation of the drain valve simultaneously with said first and second valves so that the latter close as the former opens, and the latter open as the former closes.

9. A valve system as claimed in claim 1 wherein said valve actuation means are mounted substantially wholly on said valve body remote from said first and second pipelines.

* * * * *

UNITED STATES PATENT AND TRADEMARK OFFICE

CERTIFICATE OF CORRECTION

PATENT NO. : 4,458,706

DATED : July 10, 1984

INVENTOR(S) : Alan Scholes

It is certified that error appears in the above—identified patent and that said Letters Patent is hereby corrected as shown below:

In Column 6, line 7, delete "1" and insert therefor --7--.

Signed and Sealed this

*Twenty-second* Day of *January 1985*

[SEAL]

*Attest:*

DONALD J. QUIGG

*Attesting Officer* *Acting Commissioner of Patents and Trademarks*